US010890877B2

(12) United States Patent
Guffond et al.

(10) Patent No.: US 10,890,877 B2
(45) Date of Patent: Jan. 12, 2021

(54) HOROLOGY PAWL SYSTEM

(71) Applicant: ROLEX SA, Geneva (CH)

(72) Inventors: Eric Guffond, Mont-Saxonnex (FR); Thierry Miserez, Challex (FR)

(73) Assignee: ROLEX SA, Geneva (CH)

( * ) Notice: Subject to any disclaimer, the term of this patent is extended or adjusted under 35 U.S.C. 154(b) by 92 days.

(21) Appl. No.: 15/894,133

(22) Filed: Feb. 12, 2018

(65) Prior Publication Data

US 2018/0231934 A1 Aug. 16, 2018

(30) Foreign Application Priority Data

Feb. 13, 2017 (EP) ..... 17155912

(51) Int. Cl.
*G04B 11/04* (2006.01)
*G04B 5/00* (2006.01)

(52) U.S. Cl.
CPC ..... *G04B 11/04* (2013.01); *G04B 5/00* (2013.01)

(58) Field of Classification Search
CPC ... G04B 1/20; G04B 1/22; G04B 5/06; G04B 5/12; G04B 5/24; G04B 5/245; G04B 11/02; G04B 11/022; G04B 11/028; G04B 11/04
See application file for complete search history.

(56) References Cited

U.S. PATENT DOCUMENTS 101,398 A * 3/1870 Woerd ..... G04B 11/022 368/142
946,385 A * 1/1910 Mehl ..... G04B 11/022 368/209
3,673,791 A * 7/1972 Zaugg ..... G04B 11/026 368/209
3,733,917 A 5/1973 Nikles et al.
(Continued)

FOREIGN PATENT DOCUMENTS

CH 542 468 A 11/1973
CH 707741 A2 * 9/2014 ..... G04B 5/12
(Continued)

OTHER PUBLICATIONS

Testori, Leonard, English Translation of CH707741, originally published on Sep. 15, 2014, retrieved from Escpacenet on Sep. 19, 2019, full document (Year: 2014).*
(Continued)

*Primary Examiner* — Daniel P Wicklund
(74) *Attorney, Agent, or Firm* — Seckel IP, PLLC

(57) ABSTRACT

A pawl system (1) for a wheel (2) of a drivetrain for winding a horology barrel (3), including (i) a pawl (10) having at least one tooth (1*a*) intended to collaborate with a toothset (2*a*) of the wheel (2); and (ii) an element (6) for activating and deactivating the pawl, which is arranged so that, when it is in a first configuration, the at least one tooth (1*a*) of the pawl collaborates with the toothset (2*a*) directly or indirectly, notably under the effect of a return force returning the
(Continued)

at least one tooth (1*a*) of the pawl against the toothset (2*a*), and, when the activation and deactivation element is in a second configuration, the at least one tooth (1*a*) of the pawl does not collaborate with the toothset (2*a*) or a return force returning the at least one tooth (1*a*) of the pawl against the toothset (2*a*) is reduced.

21 Claims, 6 Drawing Sheets

(56) References Cited

U.S. PATENT DOCUMENTS

| | | | | |
|---|---|---|---|---|
| 6,485,172 | B1 | 11/2002 | Takahashi et al. | |
| 2017/0123376 | A1* | 5/2017 | Bertrand | G04B 5/18 |

FOREIGN PATENT DOCUMENTS

| | | | |
|---|---|---|---|
| CN | 203054455 | U | 7/2013 |
| EP | 1 136 892 | A1 | 9/2001 |
| EP | 1041458 | A1 | 10/2010 |
| FR | 1 528 337 | A | 6/1968 |
| FR | 2 064 452 | A1 | 7/1971 |
| WO | 2015/193400 | A1 | 12/2015 |

OTHER PUBLICATIONS

B. Humbert, "Swiss watches with automatic winding", Ed. Scriptar SA, Lausanne, Switzerland, 1960, pp. 170-174 (with English machine translation; cited in the specification; 14 pages).

European Search Report and Written Opinion dated Sep. 4, 2017 issued in counterpart application No. EP17155912; w/ English machine translation (16 pages).

Chinese Office Action and Search Report dated Sep. 29, 2020 in counterpart application No. CN201810146238.3; with English machine-translation (total 22 pages).

* cited by examiner

HOROLOGY PAWL SYSTEM

This application claims priority of European patent application No. EP17155912.3 filed Feb. 13, 2017, the content of which is hereby incorporated by reference herein in its entirety.

The invention relates to a pawl system for a wheel of a drivetrain for winding a horology barrel. The invention also relates to a horology movement comprising such a system. The invention also relates to a timepiece comprising such a system or such a movement. The invention finally relates to a method for configuring such a movement or such a timepiece. The invention additionally relates to a method of assembling such a movement or such a timepiece. The invention further relates to a method for dismantling such a movement or such a timepiece.

Mainsprings in manually wound or automatically wound timepieces are usually kept under tension by a pawl which is designed to collaborate with a ratchet mounted squarely on the barrel arbor. More particularly, the pawl immobilizes the ratchet in the direction of unwinding of the mainspring, and disengages when the manual or automatic winding device is actuated.

Automatic winding devices are also configured in such a way as to immobilize the ratchet in the direction of unwinding of the spring so that the ratchet pawl can be removed in timepieces provided with such devices. However, there is still the problem of dismantling the automatic movement, which exposes the watchmaker to the problem of uncontrolled untimely uncoiling of the mainspring of the barrel. For this reason, known timepieces with automatic winding of the prior art also comprise a device, notably a ratchet pawl, designed to immobilize the barrel arbor. While such a solution notably allows the timepiece to be operated independently of its automatic winding module, it is nevertheless suboptimal regarding the effectiveness of the automatic winding. This is because, in such cases, the oscillating mass has to overcome the resistive torque induced by the pawl, notably the pawl spring, in order to allow automatic winding of the mainspring. Such a construction may therefore be problematical when the winding power of the oscillating mass is limited because of the dimensions of the timepiece, particularly in the case of a small-diameter and/or small-thickness automatic movement.

Patent CH542468 discloses a one-piece ratchet pawl provided with a rigid first part and with an elastic second part. The rigid part comprises a clicking tooth designed to collaborate with the toothset of the ratchet so as to immobilize the ratchet in the direction of unwinding of the mainspring, and so as to disengage from the toothset of the ratchet in the direction of coiling of the mainspring. To this end, the elastic part of the pawl takes the form of an elastic arm, which becomes set as the clicking tooth disengages from the toothset of the ratchet in order to return the clicking tooth to a position of immobilizing the toothset of the ratchet. Where such a device is incorporated into a timepiece with an automatic winding mechanism, the oscillating mass has to overcome the resistive torque induced by the pawl, notably by the elastic part of the pawl.

There are alternatives to ratchet pawls. The ratchet pawl may for example be replaced by one or more pawls arranged in one or other of the manual or automatic winding trains. The work "La montre suisse à remontage automatique [Swiss watches with automatic winding]" discloses for example, on pages 170 to 174, a unidirectional automatic winding movement having no ratchet pawl, known by the reference "Zenith No. 133". In this construction, pawls incorporated into the automatic winding module indirectly immobilize the ratchet in the direction of unwinding of the mainspring. Such a timepiece cannot therefore operate independently of its automatic winding module.

There are also alternatives to pawls. Patent application WO2015193400 discloses, in a third embodiment of the invention, a unidirectional automatic winding device equipped with an oscillating mass pivoted by two radial ball clutches mounted in opposition. A first clutch makes it possible to establish an unidirectional connection between the oscillating mass and the ratchet in a first direction of rotation of the oscillating mass. In a second direction of rotation of the oscillating mass, balls keep the automatic movement train in position and thus perform the same function as a pawl, notably a ratchet pawl. Such a configuration advantageously allows the use of a simplified automatic movement train the dead angle of which is minimized. However, just like the aforementioned Zenith caliber, such a timepiece is unable to operate independently of its automatic movement.

It is an object of the invention to provide a horology pawl system that makes it possible to overcome the aforementioned disadvantages and to improve the horology pawl systems known from the prior art. In particular, the invention proposes a horology pawl system such that the timepiece it equips can also operate without the automatic winding module and/or such that the automatic winding module does not need to overcome a resistive torque induced by a pawl.

A system according to the invention is defined in point 1 below.

1. A pawl system for a wheel of a drivetrain for winding a horology barrel, comprising:
   - a pawl having at least one tooth intended to collaborate with a toothset of the wheel; and
   - an element for activating and deactivating the pawl;
   - the activation and deactivation element being arranged in such a way that, when the activation and deactivation element is in a first configuration, the at least one tooth of the pawl collaborates with the toothset directly or indirectly, notably under the effect of a return force returning the at least one tooth of the pawl against the toothset, and, when the activation and deactivation element is in a second configuration, the at least one tooth of the pawl does not collaborate with the toothset or a return force returning the at least one tooth of the pawl against the toothset is reduced.

Embodiments of the system are defined in points 2 to 10 below.

2. The system as defined in the preceding point, wherein the wheel is a ratchet.
3. The system as defined in one of the preceding points, wherein the pawl comprises an assembly element for assembly to a frame of a movement, notably to a first end of the pawl, and wherein the pawl comprises the at least one tooth some distance away from the assembly element, notably at a second end of the pawl.
4. The system as defined in the preceding point, wherein the pawl comprises a flexible portion between the assembly element and the at least one tooth.
5. The system as defined in point 3 or 4, wherein the assembly element is an element for fixing the pawl to a frame of a movement.
6. The system as defined in point 3, wherein the pawl comprises a rigid body, wherein the assembly element is a pivot element and wherein the pawl comprises a return spring for returning the at least one tooth of the pawl against the toothset.

7. The system as defined in the preceding point, wherein the spring is formed as one with the rigid body or is an attached spring bearing directly or indirectly against the rigid body.
8. The system as defined in one of the preceding points, wherein the activation and deactivation element is an assembly means, notably a screw or a pin or an eccentric.
9. The system as defined in one of points 1 to 7, wherein the activation and deactivation element is an eccentric.
10. The system as defined in point 8 or 9, wherein the activation and deactivation element has a portion or a face parallel or substantially parallel to its cross section intended to come to bear against the pawl, notably intended to deform the pawl elastically, notably to deform the pawl elastically in bending, in the second configuration.

A movement according to the invention is defined in point 11 below.

11. A watch movement, notably an automatic watch movement, comprising a pawl system as defined in one of the preceding points.

Embodiments of the movement are defined in points 12 to 15 below.

12. The watch movement as defined in the preceding point, wherein said movement comprises an automatic movement, notably an automatic winding module, and a pawl system as defined in one of points 1 to 10, the activation and deactivation element being a means of assembly of the automatic movement, notably a means of assembly of the automatic winding module, onto a movement-blank, particularly the means of assembly being a mounting screw for mounting the automatic winding module.
13. The movement as defined in point 11 or 12, wherein the mainspring is kept under tension under the effect of the automatic movement in the second configuration of the activation and deactivation element.
14. The movement as defined in one of points 11 to 13, wherein the automatic winding module is a module fitted with reversing wheels.
15. The movement as defined in one of points 11 to 14, wherein the pawl comprises an assembly element for assembly to a frame of the movement, notably at a first end of the pawl, and wherein the pawl comprises the at least one tooth some distance away from the assembly element, notably at a second end of the pawl.

A timepiece according to the invention is defined in point 16 below.

16. A timepiece, notably a wristwatch, comprising a system as defined in one of points 1 to 10 or a movement as defined in one of points 11 to 15.

An embodiment of the timepiece is defined in point 17 below.

17. The timepiece as defined in the preceding point, wherein the activation and deactivation element is a means of assembly of the timepiece, notably a means of assembly of the movement within the timepiece.

A method for configuration according to the invention is defined in point 18 below.

18. A method for configuring a horology movement as defined in one of points 11 to 15 or a timepiece as defined in either of points 16 and 17, the method comprising:
    action on the pawl activation and deactivation element so as to place it in a first configuration in which the at least one tooth of the pawl collaborates directly or indirectly with the toothset, notably by obstacle and/or under the effect of a return force returning the at least one tooth of the pawl against the toothset, and/or
    action on the pawl activation and deactivation element so as to place it in a second configuration in which the at least one tooth of the pawl does not collaborate with the toothset or in which a return force returning the at least one tooth of the pawl against the toothset is reduced.

The attached figures depict, by way of examples, three embodiments of a timepiece according to the invention.

A first embodiment of a timepiece 110 is described hereinafter with reference to FIGS. 1 to 7. The timepiece is, for example, a watch, particularly a wristwatch. The timepiece comprises a mechanical watch movement 100, notably an automatic watch movement.

Figure 4:
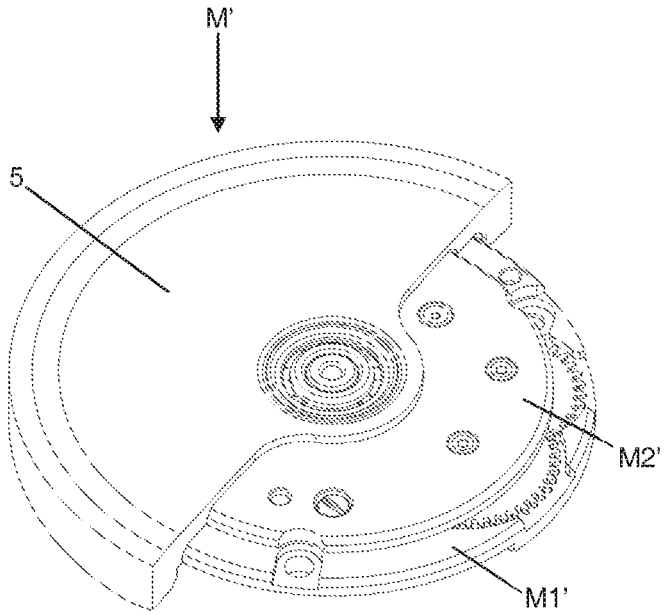
FIG. 4 is a view of an automatic winding module.
Figure 5:
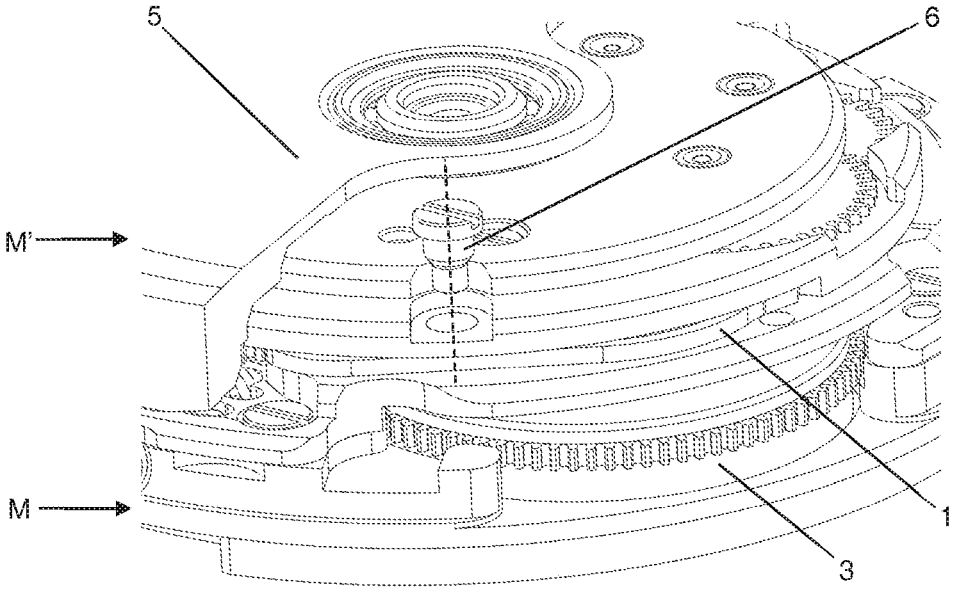
FIGS. 5 and 6 are views illustrating the assembly of the automatic winding module of FIG. 4 in order to obtain the first embodiment of a timepiece.

Advantageously, the watch movement comprises a frame 99, a horology barrel 3, a geartrain and an automatic movement or automatic winding device. The automatic winding device may be an automatic winding module M' as depicted in FIG. 4. What is meant throughout this document by an "automatic movement" or "automatic winding device" is a drivetrain for automatically winding the horology barrel 3 of the movement or part of a drivetrain for automatically winding the horology barrel 3 of the movement. The part of the drivetrain comprises at least an oscillating mass 5 the mechanical energy of which is used to wind the barrel.

Figure 3:
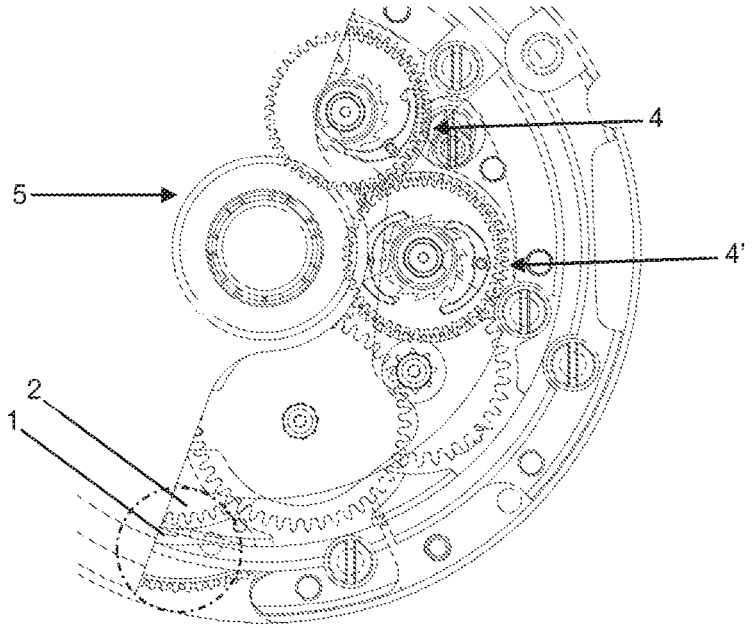

For preference, the automatic movement is bi-directional, and may notably comprise reversing wheels 4, 4'. The two reversing wheels 4, 4' on the one hand allow the ratchet to be driven by a transmission of movement from the oscillating mass 5 in the direction of coiling of a mainspring and, on the other hand, allow the ratchet to be immobilized in the direction of unwinding of the mainspring under the effect of the oscillating mass 5 as depicted in FIG. 3. Indeed, the drivetrain for the automatic winding of the movement is irreversible. Thus, the automatic movement is preferably designed to immobilize a ratchet or a wheel in a direction of unwinding of the mainspring. For preference, the automatic movement takes the form of an automatic winding module M' which for example comprises two movement-blanks M1', M2' pivoting various geartrains of the automatic movement and the oscillating mass 5.

The movement comprises a pawl system for a wheel 2 of the drivetrain for winding the horology barrel 3, namely a pawl system for immobilizing a wheel 2 of the drivetrain for winding the horology barrel 3.

The pawl system comprises:

a pawl 10 having at least one tooth 1*a* intended to collaborate with a toothset 2*a* of the wheel 2; and an element 6 for activating and deactivating the pawl.

The activation and deactivation element is arranged in such a way that, when the activation and deactivation element is in a first configuration (depicted in FIG. 1), the at least one tooth 1*a* of the pawl collaborates with the toothset 2*a* directly or indirectly, notably by obstacle and/or under the effect of a return force returning the at least one tooth 1*a* of the pawl against the toothset 2*a*, and, when the activation and deactivation element is in a second configuration (depicted in FIG. 2), the at least one tooth 1*a* of the pawl does not collaborate with the toothset 2*a* or a return force returning the at least one tooth 1*a* of the pawl against the toothset 2*a* is reduced, notably reduced by comparison with the return force that returns the at least one tooth 1*a* of the pawl against the toothset 2*a* in the first configuration.

In other words, the activation and deactivation element comprises:

a first activation configuration or a first activation position, in which the activation and deactivation element activates the pawl, namely that the at least one tooth 1*a* of the pawl collaborates directly or indirectly with the toothset 2*a*, notably by obstacle and/or under the effect of a return force returning the at least one tooth 1*a* of the pawl against the toothset 2*a*, and a second deactivation configuration or a second deactivation position, in which the activation and deactivation element deactivates the pawl, namely that the at least one tooth 1*a* of the pawl does not collaborate with the toothset 2*a* or that a return force returning the at least one tooth 1*a* of the pawl against the toothset 2*a* is reduced, notably reduced as compared with the return force returning the at least one tooth 1*a* of the pawl against the toothset 2*a* in the first configuration.

In the various embodiments described, for preference, in the second configuration of the activation and deactivation element, the at least one tooth 1*a* of the pawl does not collaborate with the toothset 2*a*.

Advantageously, the pawl and the barrel ratchet are secured together in the first activation configuration or the first activation position of the activation and deactivation element, and the pawl and the barrel ratchet are disconnected in the second deactivation configuration or the second deactivation position of the activation and deactivation element.

In a first alternative form of the first embodiment depicted in FIGS. 1 to 6, the pawl 10 comprises an assembly element 1*c* for assembly to the frame 99 of the movement 100. The assembly element is preferably located at a first end of the pawl. The assembly element for example comprises a shaping such as a heel 1*c* equipped with a first hole intended to accept a peg or a pin and a hole for the passage of a screw. The screw passes through the hole and is screwed into a tapped hole in the frame. The peg or the pin is housed partially in the frame and in the heel. In the first embodiment, the assembly element is an element for fixing to the frame of the movement.

The pawl comprises the at least one tooth 1*a*, notably two teeth in this first alternative form of the first embodiment, some distance away from the fixing element. For preference, the at least one tooth 1*a* is positioned at a second end of the pawl. The tooth or teeth have, for example, a profile similar to those of the teeth of the toothset 2*a*.

The pawl further comprises a flexible portion 1*b* between the fixing element 1*c* and the at least one tooth 1*a*. This portion has for example an elongate shape like a stick or an arm. For preference, in the pawl activated first configuration depicted in FIGS. 1 and 5, the at least one tooth is returned into contact with the toothset 2*a*. For preference again, in this first configuration, the pawl, particularly the flexible portion 1*b* of the pawl, is slightly preloaded and presses the at least one tooth against the toothset 2*a*.

The pawl 1 is therefore monostable. Its first position is a position in which the at least one tooth is returned into contact with the toothset 2*a*. Thus, the stable position is a position in which the at least one tooth collaborates by obstacle with the toothset 2*a* and therefore a position in which the pawl prevents the wheel 2 from rotating, in particular prevents the wheel 2 from rotating in the direction of uncoiling or unwinding of the mainspring.

In the embodiment depicted, the activation and deactivation element is a means of assembly 6. This means of assembly allows any device to be assembled on the movement. Advantageously, the means of assembly allows an automatic movement, particularly an automatic winding module M', to be assembled on the movement.

In the embodiment depicted, the means of assembly is a screw 6.

As seen previously, a first configuration of the activation and deactivation element is such that the at least one tooth 1*a* of the pawl collaborates by obstacle or interference with the toothset 2*a*, and a second configuration of the activation and deactivation element is such that the at least one tooth 1*a* of the pawl does not collaborate with the toothset 2*a* or such that the at least one tooth 1*a* of the pawl is less firmly engaged in the toothset 2*a*.

Advantageously, the first configuration is a first position of the activation and deactivation element and the second configuration is a second position of the activation and deactivation element.

Figure 2:
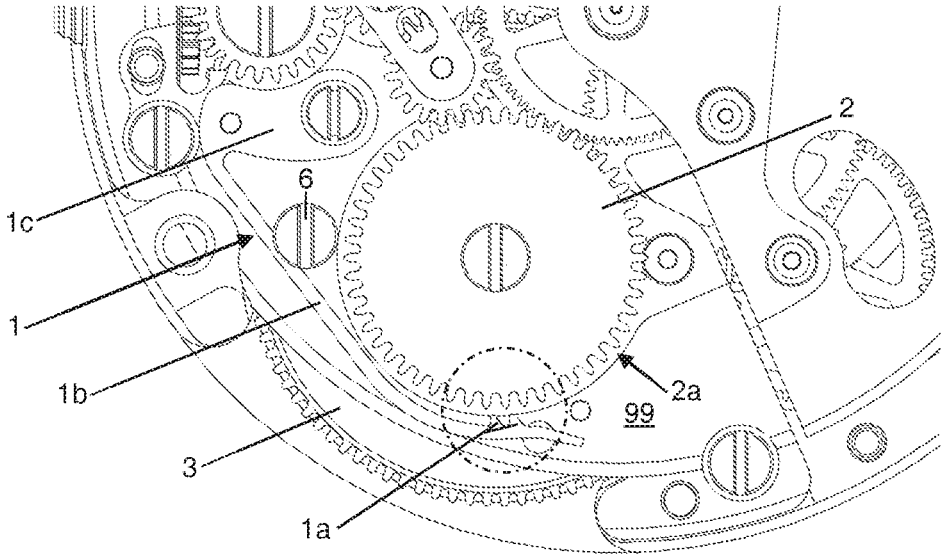
FIGS. 2 and 3 are views of the first embodiment of the horology pawl system in a deactivated configuration.
Figure 6:
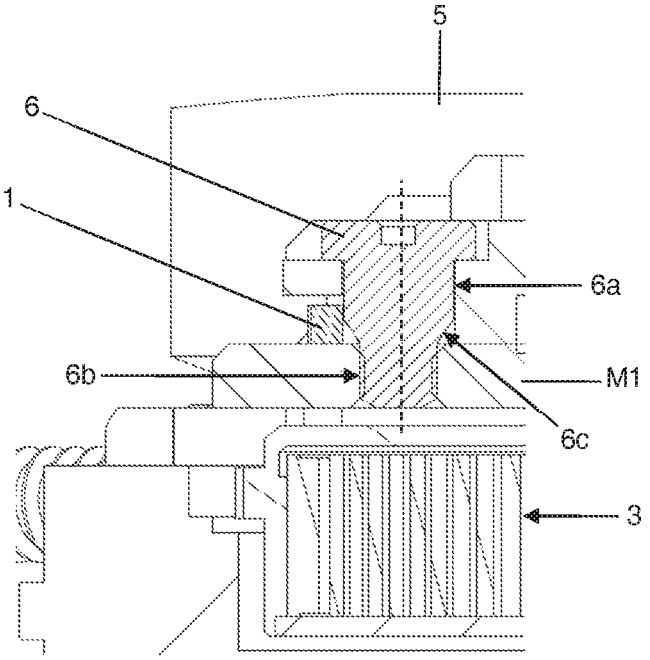

Advantageously, as depicted in FIG. 6, the means of assembly has a first portion 6*a* of a first diameter. This first diameter is such that when the means of assembly is in its second position or configuration, the pawl being in contact with or bearing against the first portion, the at least one tooth is some distance away from the toothset 2*a* or at the very least is only partially engaged in the toothset 2*a*. In this position as depicted in FIGS. 2 and 3, the pawl is elastically deformed in bending in its flexible portion 1*b*.

Figure 1:
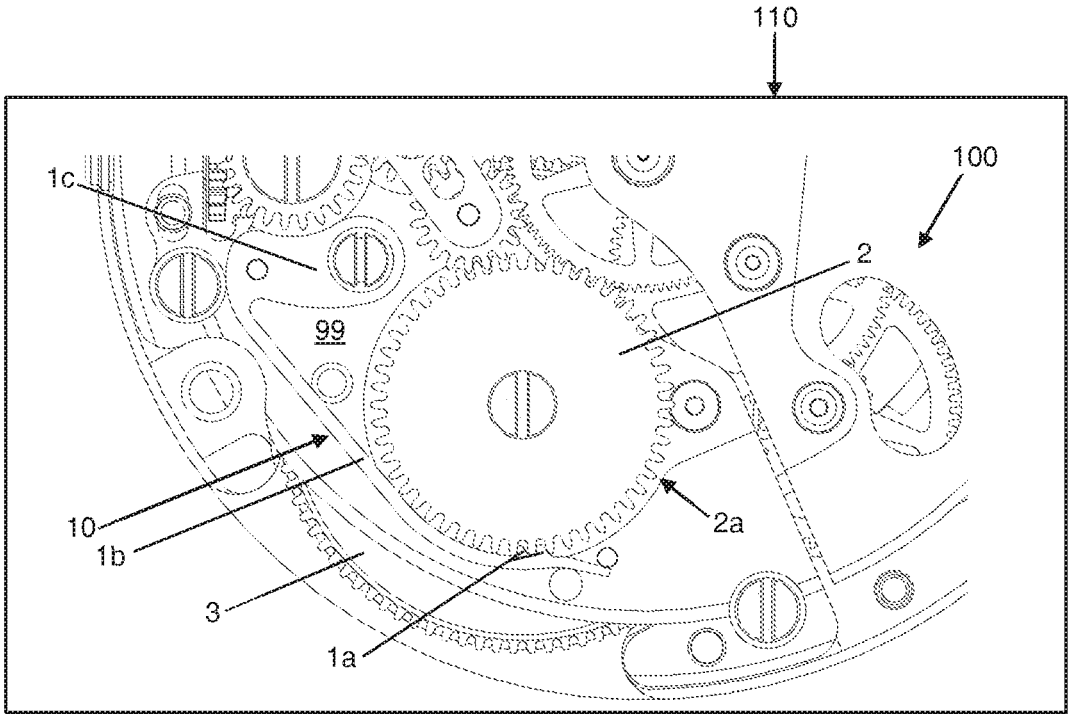
FIG. 1 is a schematic view of a first embodiment of a timepiece according to the invention comprising a first embodiment of a horology pawl system.

Advantageously, the means of assembly has a second portion 6*b*, notably a second portion of a second diameter. This second portion is for example threaded and intended to be screwed into a tapping made in the frame 99, for example on a barrel bridge M1. For preference, when a watchmaker removes the means of assembly, before this means has been completely removed, the means of assembly is in its first position or configuration. In this first position, the pawl is in contact with or bearing against the second portion, the pawl being elastically returned against this second portion by its flexible portion. It then follows that the at least one tooth is returned to a position in which it forms an obstacle or interferes with the toothset 2*a*, as depicted in FIG. 1. In this FIG. 1, the screw 6 has been completely removed.

The first and second portions are advantageously connected by a ramp, notably by a frustoconical shaping or a chamfer 6*c*.

Figure 11:
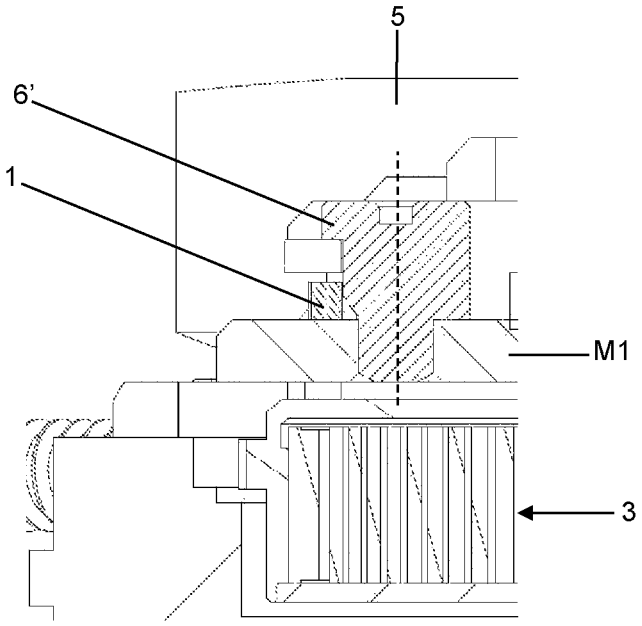
FIG. 11 is a view similar to the view of FIG. 6, in a variant embodiment where the screw 6 is replaced by an eccentric 6'.

Of course, the screw 6 could be replaced by a pin attached to or formed as one with a blank or by an eccentric 6', as illustrated on FIG. 11, or by any other means able to afford assembly. The pin could, for example, be a chamfered cylindrical pin, or alternatively a frustoconical pin. More generally, any element that protrudes from the automatic winding module could perform the function of the screw 6, such as a machining of a blank forming part of the automatic winding module, or alternatively any element attached to the automatic winding module.

For preference, the activation and deactivation element and the pawl are arranged in such a way that the at least one tooth of the pawl is moved, relative to the wheel 2, in the plane of the movement or in the plane of the wheel 2 when the activation and deactivation element moves from its first position into its second position or when the activation and deactivation element moves from its second position into its first position.

Figure 7:
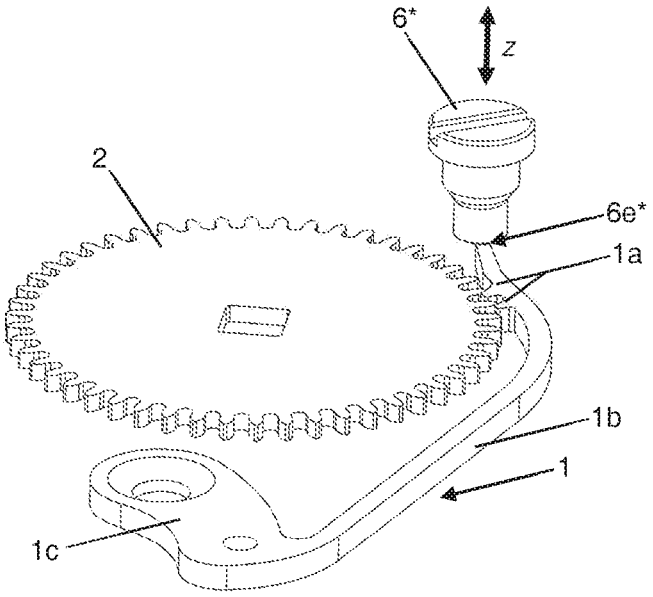
FIG. 7 is a perspective view of an alternative form of the first embodiment of the horology pawl system.

However, in a second alternative form of the first embodiment of the pawl depicted in FIG. 7, the means of assembly 6*, in this instance a screw, has a face 6*e parallel or substantially parallel to its cross section and intended to come to bear against the pawl, notably at an end near the at least one tooth 1***a*. The parallel face 6*e is intended to come to bear against the pawl in such a way as to deform it elastically, notably to deform the pawl elastically in bending, in the second configuration. Thus, in this second alternative form, the activation and deactivation element and the pawl are arranged in such a way that the at least one tooth of the pawl is moved relative to the wheel 2, perpendicular to the plane of the movement or perpendicular to the plane of the wheel 2, when the activation and deactivation element moves from its first position into its second position or when the activation and deactivation element moves from its second position into its first position. In this alternative form, the screw 6* is therefore preferably arranged above the arm 1***b* of the pawl.

A second embodiment of a timepiece 110' is described hereinafter with reference to FIG. 8. The timepiece is, for example, a watch, particularly a wristwatch. The timepiece comprises a mechanical watch movement 100', notably an automatic watch movement.

The movement comprises a pawl system for a wheel 2 of the drivetrain for winding the horology barrel 3, namely a pawl system for immobilizing a wheel 2 of the drivetrain for winding the horology barrel 3.

This second embodiment differs from the first embodiment in that it comprises a second embodiment of a pawl system 1'.

In the second embodiment, the pawl 10' comprises an assembly element 1*c*' for assembly to the frame 99 of the movement 100'. The assembly element is preferably located at a first end of the pawl. The assembly element comprises for example a shaping such as a heel 1*c*' provided with a hole for the passage of a spindle. In the second embodiment, the assembly element is a pivot element designed to pivot the pawl on the frame.

As in the first embodiment, the pawl comprises the at least one tooth 1*a*' some distance away from the assembly element. For preference, the at least one tooth 1*a*' is positioned at a second end of the pawl. In this embodiment, the at least one tooth has the shape of a jumper beak.

Unlike in the first embodiment, the pawl comprises a rigid portion 1*d*' between the pivot element 1*c*' and the at least one tooth 1*a*'. This portion has for example an elongate shape like an arm. This rigid portion experiences no or almost no deformation during normal operation of the pawl system.

For preference, in the first, activated, configuration of the pawl, the at least one tooth is returned into contact with the toothset 2*a*. In this first configuration, the pawl is loaded and presses the at least one tooth into the toothset 2*a*. This loading is obtained by an elastic arm 1*b*' of the pawl. In the first configuration, the elastic arm is deformed or preloaded to bear against the activation and deactivation element 6', which in this instance is a screw 6', notably a screw 6' provided with a frustoconical portion designed to collaborate with the elastic arm 1*b*'. In this embodiment, the elastic arm 1*b*' which acts like a spring is formed as one with the rigid body 1*d*' of the pawl. Alternatively, the spring may also be attached. It may be arranged to bear directly or indirectly against the rigid body.

The pawl 1' is therefore monostable. Its first position is a position in which the at least one tooth is returned into contact with the toothset 2*a*. Thus, this first position is a position in which the at least one tooth collaborates by obstacle with the toothset 2*a* and therefore a position in which the pawl prevents the wheel 2 from rotating, particularly prevents the wheel 2 from rotating in the direction of uncoiling or unwinding of the mainspring.

A third embodiment of a timepiece 110" is described hereinafter with reference to FIG. 9. The timepiece is, for example, a watch, particularly a wristwatch. The timepiece comprises a mechanical watch movement 100", notably an automatic watch movement.

The movement comprises a pawl system for a wheel 2 of the drivetrain for winding the horology barrel 3, namely a pawl system for immobilizing a wheel 2 of the drivetrain for winding the horology barrel 3.

This third embodiment differs from the first embodiment in that it comprises a third embodiment of a pawl system 1".

In the third embodiment, the pawl 10" differs from the pawls of the first and second embodiments in that it is made as two components: the actual pawl proper 10" and a separate spring 1*b*". The spring 1*b*" is designed to apply load to the pawl and to return it to its first position.

As in the second embodiment, the pawl comprises a rigid portion 1*d*" between a pivot element 1*c*" and the at least one tooth 1*a*". This rigid portion experiences no or almost no deformation during normal operation of the pawl system.

Figure 9:
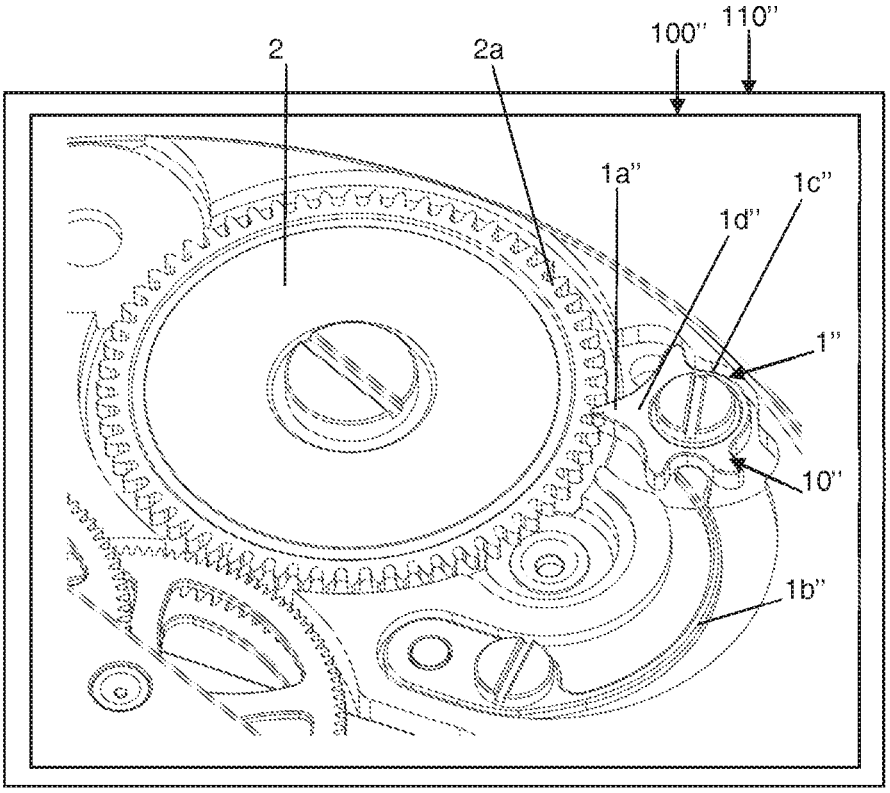
FIG. 9 is a schematic view of a third embodiment of a timepiece according to the invention comprising a third embodiment of a horology pawl system.

For preference, in the first, activated, configuration of the pawl, depicted in FIG. 9, the at least one tooth is returned into contact with the toothset 2*a*. In this first configuration, the pawl is loaded and presses the at least one tooth into the toothset 2*a*. This loading is obtained by the action of the spring 1*b*". This first configuration is obtained in a first, activation, configuration or a first, activation, position in which an activation and deactivation element (not depicted) causes activation of the pawl, namely that the at least one tooth 1*a*" of the pawl collaborates by obstacle with the toothset 2*a* under the effect of a return force returning the at least one tooth 1*a*" of the pawl against the toothset 2*a*. For example, in this first, activation, configuration or first, activation, position, the activation and deactivation element does not act on the spring 1*b*".

For example again, in a second, deactivation, configuration or a second, deactivation, position, the activation and deactivation element causes deactivation of the pawl or lesser activation of the pawl, which means to say that the at least one tooth 1*a*" of the pawl does not collaborate with the toothset 2*a* or that a return force returning the at least one tooth 1*a*" of the pawl against the toothset 2*a* is reduced.

In all the embodiments and alternative forms described, the wheel 2 is a barrel ratchet. However, the wheel 2 can also be any other wheel in the barrel winding train, notably the automatic winding train or the manual winding train. The wheel could even form part of another train in mesh with the barrel.

In all the embodiments and alternative forms described, if the activation and deactivation element is a screw for assembling the automatic winding module, as soon as the screw is unscrewed during the dismantling of the automatic winding module, the pawl switches from the second configuration to the first configuration in which the at least one tooth 1*a*, 1*a*', 1*a*" of the pawl is in mesh with the toothset 2*a*, notably under the effect of a spring.

In all the embodiments and alternative forms described, the activation and deactivation element is a means of assembly. Alternatively, the activation and deactivation element may have any other function. The activation and deactivation element may also be dedicated to the single activation and deactivation function alone. The activation and deactivation element may for example comprise an eccentric.

In all the embodiments and alternative forms described, the stiffness of the pawl spring may be inhibited, so as to significantly minimize the resistive torque of the pawl during operation of the automatic winding device. In such a configuration, the pawl is preferably a jumper 1' as in the second embodiment.

In all the embodiments and alternative forms described, the pawl is monostable. Thus, it retracts from the toothset 2*a* against the action of a spring that is set at the time of retraction. The elastic stiffness of the spring can also be inhibited. The restitution or the resetting of the spring causes the pawl to return to the position of the first configuration.

Alternatively, the pawl may take the form of a bistable rocker lever, namely a rocker lever provided with two stable positions, which are defined, for example, by flexible structures, notably by the buckling of one or more flexible leaves. In such a configuration, the state of the rocker lever in its first position or in its second position is dictated by the state of the activation and deactivation element.

Figure 8:
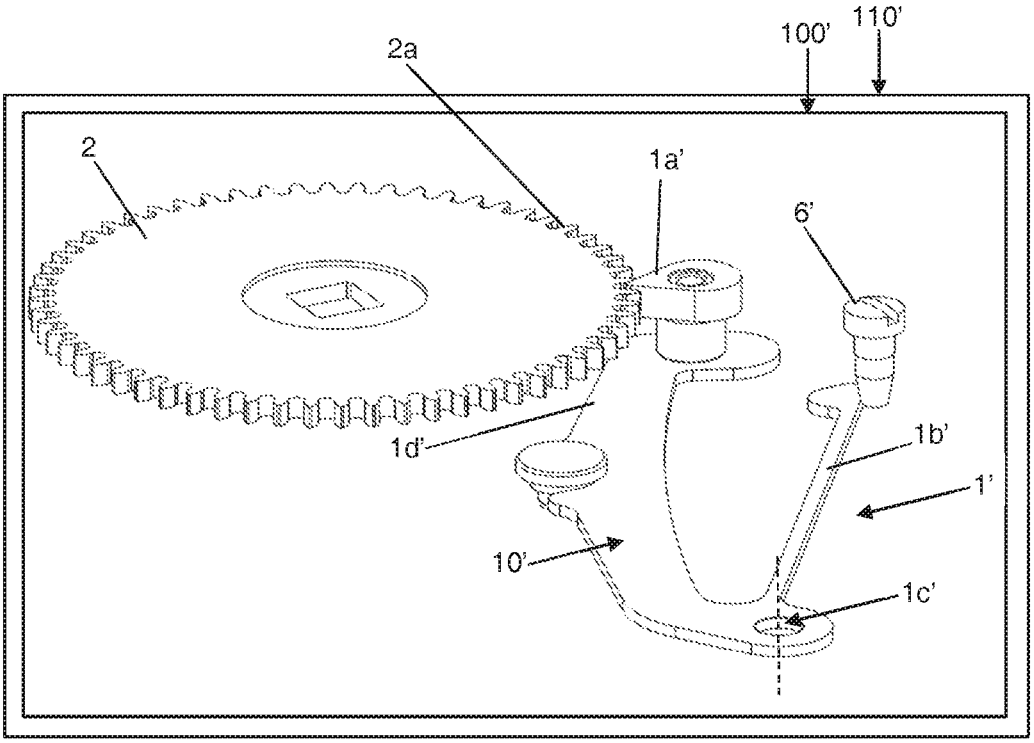
FIG. 8 is a schematic view of a second embodiment of a timepiece according to the invention comprising a second embodiment of a horology pawl system.

As was seen earlier, the pawl may be a one-piece component as illustrated in FIGS. 1, 2, 7 and 8 or may alternatively be an assembly as illustrated in FIG. 9. The pawl may also be a rigid component elastically returned by a spring as illustrated in FIGS. 8 and 9.

As seen previously, the pawl is designed to collaborate directly with a ratchet wheel 2. What is meant here by "directly" is that the pawl is preferably designed to come into mesh with the toothset of the ratchet. Alternatively, the pawl may collaborate with the toothset of another geartrain of the movement manual winding train which is in mesh with the ratchet wheel. The pawl may for example collaborate with the crown wheel which is in mesh with the ratchet wheel. In such a case, the principle of operation is entirely unchanged. As an alternative still, the crown wheel or any other geartrain in the manual winding train which is indexed by such a pawl may have a degree of freedom in such a way as to be able to be retracted from the toothset of the ratchet under the effect of the automatic winding module, and more particularly of the means of assembly of the automatic winding module. To this end, such a geartrain could, for example, be pivoted by an olived tenon or by a rocker lever.

Figure 10:
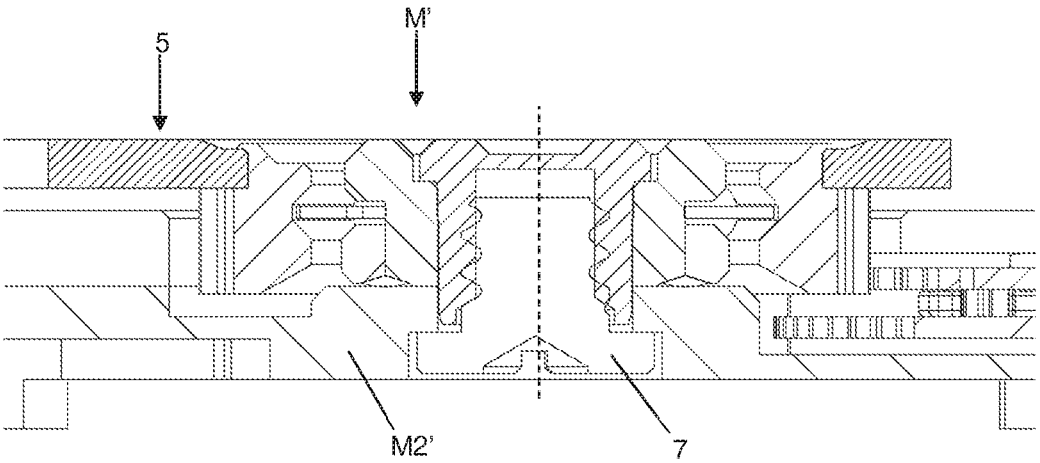
FIG. 10 is a view in partial section of one embodiment of an automatic winding module used for preference in a horology movement according to the invention.

Whatever the embodiment, the pawl is positioned in its first configuration as soon as the oscillating mass is removed, and preferably just before the oscillating mass is removed. In this way, any risk of untimely uncoiling of the mainspring is avoided. For preference, the automatic winding module M' is designed in such a way that the oscillating mass cannot be removed from the movement before the module has been removed, and notably before a screw the state of which dictates the state of the pawl has been unscrewed. For preference, in one particular construction, a screw 7 for assembling and dismantling the oscillating mass 5 is not accessible while the automatic winding module M' is assembled on the movement. The screw 7 is for example fitted from the underside of the automatic winding module M', as illustrated in FIG. 10.

Advantageously, the horology movement with automatic winding offers the particular feature of being provided with a disengagable pawl or pawl that can be activated and deactivated according to the state of assembly of the horology movement. Thus, it is possible to inhibit the function of the pawl during actuation of the automatic winding device and to activate the function of the pawl when the automatic winding device is removed from the movement. As a result, during operation of the automatic winding device, the oscillating mass does not need to overcome the resistive torque induced by the pawl, and notably the pawl spring, in order to allow automatic winding of the mainspring. Such a solution is particularly advantageous regarding its simplicity and the expected advantages.

In one preferred embodiment, the automatic winding movement offers the particular feature of being provided with a pawl that can be activated and deactivated according to the state of assembly of an automatic winding module M'.

In a first configuration or state of assembly of the movement corresponding to the horology movement without the automatic winding module, the pawl is activated in such a way as to immobilize the ratchet in the direction of unwinding of the mainspring. During operation of the movement without the automatic winding module, the pawl retracts during the winding but is immediately returned to a configuration of interference with a toothset so as to avoid any movement of the toothset in the direction of unwinding of the barrel.

In a second configuration or state of assembly of the movement corresponding to the horology movement with the automatic winding module, the pawl is deactivated so as to avoid interference with a toothset. For example, the at least one tooth of the pawl is out of reach of the toothset so as not to oppose the movement of the oscillating mass during operation of the automatic winding module.

In this particular construction, the automatic winding module M', particularly the means of assembly of the automatic winding module on the movement, governs the state of the ratchet pawl to configure it into its activated or deactivated state. For example, as was seen earlier, an assembly screw for assembling the automatic winding module on the movement may exhibit a specific shaping which allows it to move, or to cause to move, notably in the plane of the frame of the movement, the pawl during assembly and dismantling of the automatic winding module M'. To achieve this, the screw 6 may, as was seen earlier, have a body portion 6*a* shaped to come into contact with the pawl as the screw 6 is screwed onto the rest of the movement M, particularly onto a barrel bridge M1. For preference, the screw 6 has at least two distinct portions 6*a*, 6*b* separated by a chamfer 6*c* so that the latter constitutes a ramp to allow the pawl to be moved, and therefore allow at least one tooth 1*a*, 1*a*', 1*a*" to be moved away from the toothset 2*a* as the screw 6 is screwed in. Thus, at the start of the screwing-in of the screw 6, the pawl is in a first configuration and, at the end of the screwing-in of the screw 6, the pawl is in a second configuration. Advantageously, in the second configuration of the activation and deactivation element 6, the mainspring is kept under tension under the effect of the automatic movement.

The various embodiments relate to a movement with automatic winding, which has the particular feature of being provided with a pawl that can be disengaged or deactivated according to the state of assembly of an automatic winding module M'. More generally, the horology movement with automatic winding exhibits the particular feature of being provided with a pawl that can be activated and deactivated according to the state of assembly of the horology movement, particularly according to the state of assembly of the horology movement to the framework. For example, the pawl may be deactivated upon final assembly of the movement within a watch case. The pawl may, for example, be deactivated by an element of the case such as the case back. For example, the case back may be provided with a pin that is designed to collaborate with the pawl so that the latter is retracted from a toothset of the ratchet once the case back of the case has been assembled. Such a design also makes it possible to inhibit or deactivate the pawl upon actuation of the automatic winding device, and to guarantee activation of the pawl when the automatic movement is removed from the movement once the movement has been taken out of the case. Such a design is particularly well suited to a movement provided with an oscillating mass that does not cover the entire movement, for example for a movement of the micro-rotor type.

Optionally, such a device may also be driven by an additional control, for example by the stem of the horology movement. Thus, the activation and deactivation element can have its state changed under the effect of an ancillary device, which is preferably activated by a mechanism at the stem of the horology movement. For example, the activation and deactivation element may have an elastic structure or an additional degree of freedom so that it can be retracted.

Advantageously, a horology movement as described hereinabove or a timepiece as described hereinabove is configured by employing at least one of the following steps:

action on the pawl activation and deactivation element so as to place it in a first configuration in which the at least one tooth of the pawl collaborates, notably by obstacle, with the toothset and/or under the effect of a return force returning the at least one tooth of the pawl against the toothset, action on the pawl activation and deactivation element so as to place it in a second configuration in which the at least one tooth of the pawl does not collaborate with the toothset or in which a return force returning the at least one tooth of the pawl against the toothset is reduced, notably reduced with respect to the return force returning the at least one tooth 1*a* of the pawl against the toothset 2*a* in the first configuration.

For preference, the first step mentioned hereinabove is implemented during a method of dismantling the horology movement or the timepiece.

For preference, the second step mentioned hereinabove is implemented during a method of assembling the horology movement or the timepiece.

In this whole document, the term «pawl» or «click» preferentially means a mechanism for stopping a part (usually a wheel or a ratchet) in a first direction only and for allowing it to rotate in a second direction (opposite to the first direction). In a watch, the pawl prevents the ratchet-wheel from turning backwards when the winding-action stops. The pawl may be a lever provided with a beak which engages in the teeth of a wheel, under the action of a spring.

In this whole document, the term «activated pawl» preferentially means that the pawl stops the part in the first direction only and allows it to rotate in the second direction.

In this whole document, the term «deactivated pawl» or «unclicked pawl» preferentially means that the pawl allows the part to rotate in both first direction and second direction.

The invention claimed is:

1. A horology movement comprising:

an automatic movement, a drivetrain configured for winding a horology barrel, and a pawl system for a wheel of the drivetrain configured for winding the horology barrel, the pawl system comprising:

a pawl having at least one tooth intended to collaborate with a toothset of the wheel; and an element for activating and deactivating the pawl;

the activation and deactivation element being movable between a first, activation configuration and a second, deactivation configuration, and the activation and deactivation element being arranged so that, when the activation and deactivation element is in the first configuration, the at least one tooth of the pawl collaborates with the toothset directly or indirectly, and, when the activation and deactivation element is in the second configuration, the at least one tooth of the pawl does not collaborate with the toothset or a return force returning the at least one tooth of the pawl against the toothset is reduced, wherein, when the horology movement is assembled in an operating configuration, the activation and deactivation element is in the second configuration.

2. The horology movement as claimed in claim 1, wherein the wheel is a ratchet.

3. The horology movement as claimed in claim 1, wherein the pawl comprises an assembly element for assembly to a frame of a movement, and wherein the pawl comprises the at least one tooth some distance away from the assembly element.

4. The horology movement as claimed in claim 3, wherein the pawl comprises a flexible portion between the assembly element and the at least one tooth.

5. The horology movement as claimed in claim 3, wherein the assembly element is an element for fixing the pawl to a frame of a movement.

6. The horology movement as claimed in claim 3, wherein the pawl comprises a rigid body, wherein the assembly element is a pivot element and wherein the pawl comprises a return spring for returning the at least one tooth of the pawl against the toothset.

7. The horology movement as claimed in claim 6, wherein the spring is formed as one with the rigid body or is an attached spring bearing directly or indirectly against the rigid body.

8. The horology movement as claimed in claim 3, wherein the assembly element is for assembly to a first end of the pawl, and wherein the at least one tooth is at a second end of the pawl.

9. The horology movement as claimed in claim 1, wherein the activation and deactivation element is an assembly means enabling assembly of the automatic movement in the horology movement.

10. The horology movement as claimed in claim 9, wherein the activation and deactivation element has a portion or a face parallel or substantially parallel to a cross section thereof, intended to come to bear against the pawl in the second configuration.

11. The horology movement as claimed in claim 9, wherein the activation and deactivation element is a means of assembly of the automatic movement onto a movement-blank.

12. The horology movement as claimed in claim 11, wherein the mainspring is kept under tension under the effect of the automatic movement in the second configuration of the activation and deactivation element.

13. The horology movement as claimed in claim 11, wherein the automatic winding module is a module fitted with reversing wheels.

14. The horology movement as claimed in claim 1, wherein the activation and deactivation element is an eccentric.

15. The horology movement as claimed in claim 1, wherein the pawl comprises an assembly element for assembly to a frame of the movement, and wherein the pawl comprises the at least one tooth spaced away from the assembly element.

16. A timepiece comprising a horology movement as claimed in claim 1.

17. The timepiece as claimed in claim 16, wherein the activation and deactivation element is a means of assembly of the timepiece.

18. A method for configuring a horology movement as claimed in claim 1, the method comprising at least one selected from the group consisting of:

acting on the pawl activation and deactivation element so as to place the pawl activation and deactivation element in the first configuration in which the at least one tooth of the pawl collaborates directly or indirectly with the toothset, and acting on the pawl activation and deactivation element so as to place the pawl activation and deactivation element in the second configuration in which the at least one tooth of the pawl does not collaborate with the toothset or in which the return force returning the at least one tooth of the pawl against the toothset is reduced.

19. The horology movement as claimed in claim 1, wherein, when the activation and deactivation element is in the first configuration, the at least one tooth of the pawl collaborates with the toothset under the effect of the return force returning the at least one tooth of the pawl against the toothset.

20. The horology movement as claimed in claim 1, wherein the activation and deactivation element is configured to contribute to the assembly of a device in the horology movement.

21. The horology movement as claimed in claim 20, wherein the device is the automatic movement.

* * * * *